US005555588A

United States Patent [19]

Viesehon

[11] Patent Number: 5,555,588

[45] Date of Patent: Sep. 17, 1996

[54] DEVICE FOR CLEANING THE INTERIOR OF A WIND INSTRUMENT

[76] Inventor: Karl-Heinz Viesehon, Kantstr. 7, 40789 Monheim, Germany

[21] Appl. No.: 199,571

[22] Filed: Feb. 17, 1994

[30] Foreign Application Priority Data

Feb. 19, 1993 [DE] Germany ..... 43 05 118.9

[51] Int. Cl.[6] ..... B05C 17/00; A47L 13/46; G10G 7/00

[52] U.S. Cl. ..... 15/104.16; 15/244.1; 15/104.5; 84/453

[58] Field of Search ..... 15/244.1, 211, 15/222, 212, 213, 209.1, 210.1, 244.2, 244.3, 244.4, 104.5, 104.31, 104.33, 104.16; 84/453

[56] References Cited

U.S. PATENT DOCUMENTS

| | | | |
|---|---|---|---|
| 126,084 | 4/1872 | Prouty | 15/211 |
| 219,384 | 9/1879 | Brown | 15/104.16 |
| 387,410 | 8/1888 | Gillette | 15/104.16 |
| 856,063 | 6/1907 | Howell | 15/104.16 |
| 1,350,807 | 8/1920 | Jackson | 15/211 |
| 1,421,529 | 7/1922 | Millhouse | 15/211 |
| 1,730,785 | 10/1929 | Romao | 15/211 |
| 1,980,826 | 11/1934 | Reiss | 15/209.1 |
| 2,154,831 | 4/1939 | Booharin | 15/222 |
| 2,537,149 | 1/1951 | McKean | 15/211 |
| 2,960,711 | 11/1960 | Schoenfield et al. | 15/244.1 |
| 3,296,644 | 1/1967 | Weisberg | 15/222 |
| 3,739,420 | 6/1973 | Kafkis | 15/211 |
| 3,778,859 | 12/1973 | Donnelly | 15/104.16 |
| 4,114,504 | 9/1978 | Koregelos | 84/453 |
| 5,212,332 | 5/1993 | Gigliotti | 15/211 |
| 5,331,709 | 7/1994 | Hudson | 15/244.1 |

FOREIGN PATENT DOCUMENTS

| | | | |
|---|---|---|---|
| 3715490 | 11/1988 | Germany . | |
| 9214532 | 3/1993 | Germany . | |
| 413636 | 7/1934 | United Kingdom | 15/244.1 |

*Primary Examiner*—Gary K. Graham
*Attorney, Agent, or Firm*—Robert W. Becker & Associates

[57] ABSTRACT

A device for cleaning the interior of a wind instrument has a cleaning body having a convexly curved part and a plate-shaped part with a top side and a bottom side, wherein the convexly curved part is connected to the top side. An elongate part is connected to the convexly curved part for pulling the device through the wind instrument. Preferably, the plate-shaped part is a circular disk and the convexly curved part is a semi-sphere.

10 Claims, 3 Drawing Sheets

DEVICE FOR CLEANING THE INTERIOR OF A WIND INSTRUMENT

BACKGROUND OF THE INVENTION

The present invention relates to a device for cleaning the interior of wind instruments with a cleaning body that comprises a convexly outwardly curved part having at its forward end an elongate part for pulling the cleaning body through the interior of the instrument.

There is a great need to clean the interior of wind instruments. During the course of time different materials are deposited in the interior of the instrument that may consolidate to a solid coating. This coating not only results in a slow deterioration of the instrument but also in a disadvantageous effect on the sound properties of the instrument so that the quality of the wind instrument slowly deteriorates. Accordingly, woodwind instruments and flutes as well as recorders must be cleaned internally after each use in order to prevent fissures within the wood and damage to the keys.

The cleaning device for the interior of woodwind instruments of the aforementioned kind is known from German Offenlegungsschrift 37 15 490. The cleaning device is comprised of a pulling part in the form of a flexible cord. At one end of this cord a cleaning element in the form of a spherical piece of foamed rubber, foamed plastic or foamed latex is provided. The other end of the flexible cord is provided with a threading device that is also spherical. With such a cleaning device relatively good cleaning effects are to be obtained; however, for some wind instruments the coating especially at critical locations cannot be removed in an optimal manner.

From German Gebrauchsmuster 92 14 532 a cleaning device for flutes is known. The cleaning device is comprised of a rod that at one end has a round head plate. With this cleaning device only flutes or similar instruments can be cleaned.

It is therefore an object of the present invention to provide a cleaning device for wind instruments of the aforementioned kind with which an improved cleaning effect is attainable in a simple and effective manner.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
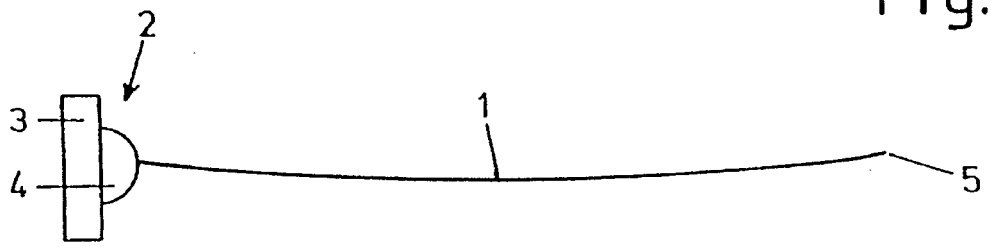
FIG. 1 shows a side view of a first embodiment with a flexible cord and a pointed end.

The device for cleaning the interior of a wind instrument according to the present invention is primarily characterized by:

A cleaning body having a convexly curved part and a plate-shaped part with a top side and a bottom side, wherein the convexly curved part is connected to the top side; and An elongate part connected to the convexly curved part for pulling the device through the wind instrument.

Preferably, the plate-shaped part is a circular disk. Advantageously, the convexly curved part is a segment of a sphere, preferably a semi-sphere. Advantageously, the segment of the sphere has a diameter that is smaller than the diameter of the circular disk.

Expediently, the cleaning body is made of at least one of the materials selected from the group consisting of foamed rubber, foamed plastic, and foamed latex.

In a preferred embodiment of the present invention, the cleaning body further comprises a rag positioned at the convexly curved part opposite the plate-shaped part, the rag covering the convexly curved part. Advantageously, the rag is made of a material selected from the group consisting of cloth and leather.

Advantageously, the elongate part is a flexible cord. Preferably, the cord is made of plastic. In a preferred embodiment of the present invention, the cord has a body connected to a free end thereof for stringing the cord through the wind instrument.

In a further embodiment of the present invention, the elongate part is a cord having a pointed end for stringing the cord through the wind instrument.

Advantageously, the device further comprises a pulling cord connected to the bottom side of the plate-shaped part.

In another embodiment of the present invention, the elongate part is a flexible rod.

Advantageously, the device further comprises a rag connected to the bottom side of a plate-shaped part. Preferably, the rag is made of a material selected from the group consisting of leather and cloth.

The cleaning device of the present invention has the advantage that with it in an optimal manner the interior of wind instruments can be cleaned and dried This is achieved with a special shaping of the cleaning body which has a special profiling, i.e., a plate-shaped part having on one flat side thereof a convexely curved part arranged such that the convexly curved part represents a projection of the plate-shaped part. The cleaning body is made of flexible, respectively, compressible material such that after exerting a pressure onto it, for example, during pulling through a wind instrument, the cleaning body returns into its initial shape. The dimensions of the cleaning body as well as the dimensions of the elongate (pulling) part depend on the dimensions of the respective instrument for which the cleaning device is to be used. The plate-shaped part and the convexly curved part may be made of the same material or made of two different materials. Inasmuch as the two different parts are comprised of two different materials, they can be adapted to perform different tasks. The two parts may for example be glued together. In the case that both parts are made of the same material, the cleaning body may be made as a unitary part. It is also possible to produce the plate-shaped part and the convexly curved part individually and to subsequently connect them for example by gluing. Thus, different parts of different sizes can be combined for producing cleaning bodies of various size and designs.

In a preferred embodiment of the inventive cleaning device it is suggested that the plate-shaped part be a circular disk. Such a round or circular disk in the form of a flat cylinder is technically easy to manufacture and has also a very high transfer stability, whereby the edge portion of the disk is in contact with the inner walls of the instrument to be cleaned.

In another preferred embodiment of the inventive cleaning device it is suggested that the curved part is a segment of a sphere, especially a semi-sphere. Due to this spherical form the cleaning body can be threaded without problems through the wind instrument whereby it is advantageous that the cleaning body comes into contact with a relatively large surface area of the inner wall of the wind instrument. Of course, the curved part may also be based on an ellipsoid or a similarly curved body.

A further embodiment suggests that the diameter of the spherical part is smaller than the diameter of the circular or round disk. This allows for an optimal cleaning effect whereby the exact sizes of the wound or circular disk as well as of the segment of the sphere depend on the respective application.

In another preferred embodiment of the present invention, the cleaning body is made of foamed rubber, foamed plastic or foamed latex. These materials on the one hand are flexible and compressible, so that they can be pulled through the wind instrument without problems; on the other hand, they provide for an extremely good cleaning and drying effect.

In another embodiment of the present invention, the cleaning body is additionally provided on the sides of the curved part with a rag, especially made of leather or cloth. This additional cleaning element is especially suitable for cleaning devices for clarinets, saxophones, oboes, or bassoons.

In another embodiment it is suggested that the elongate (pulling) part is a flexible cord, especially made of plastic. Preferably, the flexible cord is a nylon cord. On the one hand, such a cord is flexible to allow threading or stringing it through curved portions of wind instruments; on the other hand, such a cord is acceptable from a hygienic point of view because it can be easily cleaned by washing. Furthermore, such a cord does not damage the inner walls of the instrument to be cleaned or dried.

The free end of the cord preferably is provided with a threading body. Such a threading body can be, for example, in the form of a sphere made of wood or lead. A sphere of lead has an extremely high weight so that the flexible cord can follow without problems curves within the instrument when the user rotates the instrument to be cleaned correspondingly. In order to prevent damage, the lead sphere should be enclosed by a plastic envelope/cover.

In the alternative, it is also possible to provide the end of the cord with a pointed end.

In another embodiment of the present invention it is suggested that on the bottom side of the plate-shaped part a second cord is provided. Such a cleaning device in combination with the aforementioned rags is especially suitable for soprano saxophones.

As an alternative to the flexible cord it is also possible to provide an elongate pulling part in the form of a pushing part that is shaped as a flexible rod. Such a cleaning element, for example, comprised of a plastic rod, especially a PVC rod, is insertable into the instrument without problems in order to thereby reach locations to be cleaned or dried. By moving the cleaning element back and forth, the cleaning and drying effect is attained.

In another embodiment it is suggested that at the plate-shaped part, at the side facing away from the convexly curved part, a further rag, especially made of leather or cloth, is provided. Such a cleaning device with a flexible rod and a leather rag is especially suitable for cleaning flutes.

DESCRIPTION OF PREFERRED EMBODIMENTS

The present invention will now be described in detail with the aid of several specific embodiments utilizing FIGS. 1 through 6.

FIG. 1 shows a first embodiment of the cleaning device that is especially suitable for cleaning trombones. The cleaning device is provided with an elongate pulling part in the form of a flexible cord 1 made of plastic, especially nylon. At one end of the cord 1 a cleaning body 2 is arranged. This cleaning body is comprised of a plate-shaped part 3 in the form of a cylindrical, round (circular) disk. On the top side of the plate-shaped part 3 a convexly curved part 4 in the form of a semi-sphere is provided. The plate-shaped part 3 as well as the convexly curved part 4 are made of foamed latex, but may also be comprised of other comparable materials such as foamed rubber or foamed plastic. The free end of the cord 1 is provided with a pointed end 5 for threading the cord through the trombone.

It is also possible to provide the cleaning body 2 simply as a semi-sphere, i.e., without the plate-shaped part 3.

Figure 2:
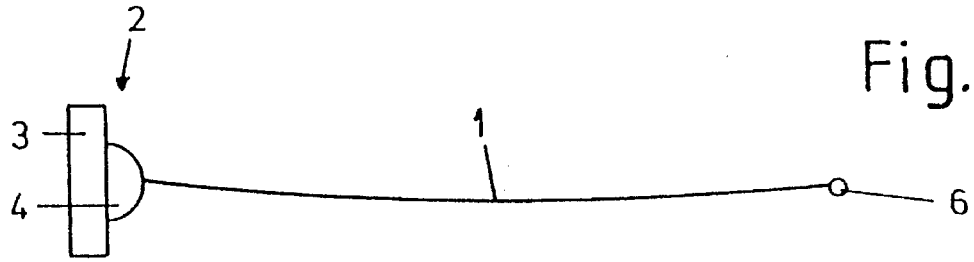
FIG. 2 shows a second embodiment whereby the flexible cord has at its free end instead of a pointed end a threading ball.

The embodiment in FIG. 2 differs from the embodiment of FIG. 1 by providing a threading body 6 instead of the pointed end 5. The threading body 6 is preferably in the form of a wooden ball. Such a variation of the cleaning device is especially suitable for horns.

Figure 3:
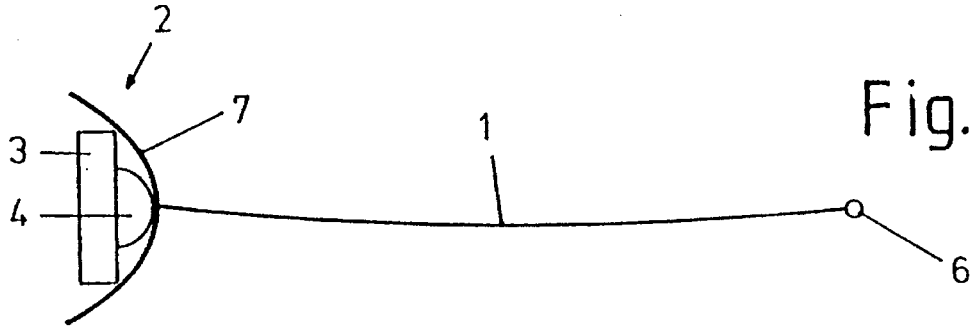
FIG. 3 shows a third embodiment corresponding to FIG. 2 however having an additional leather rag covering the cleaning body.

FIG. 3 shows a further embodiment of the variant of FIG. 2. In this embodiment, the cleaning body 2 is provided with a rag 7 made of leather that is slipped onto the cord 1 and rests on the convexly curved part 4 to thereby essentially enclose the cleaning body 2. This variant is especially suitable for cleaning clarinets and saxophones.

Figure 4:
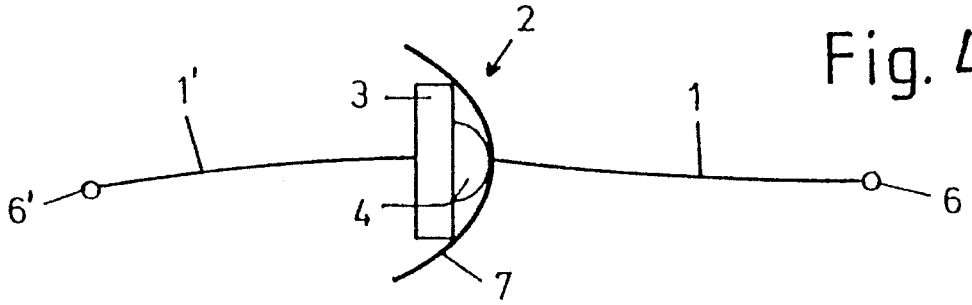
FIG. 4 shows a fourth embodiment based on the third embodiment whereby in the fourth embodiment an additional second cord is provided.
Figure 1A:
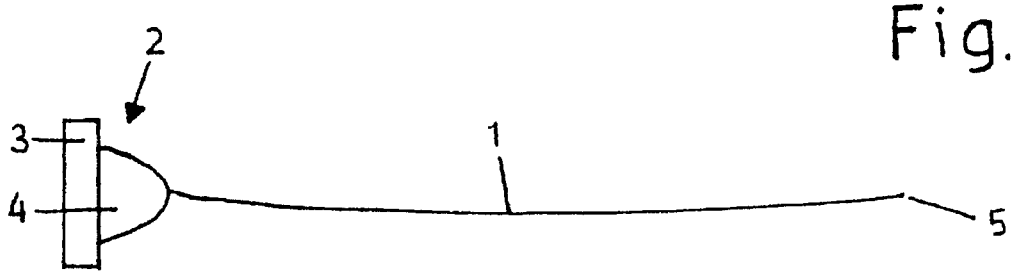
FIG. 1*a* shows a side view of a variation of the first embodiment with a convexly curved part in the form of an ellipsoid segment.
Figure 2A:
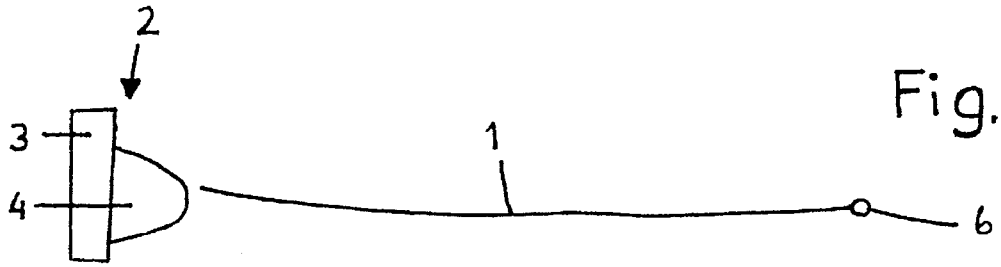
FIG. 2*a* shows a side view of a variation of the second embodiment with a convexly curved part in the form of an ellipsoid segment.

The embodiment according to FIG. 4 is a further development of the embodiment of FIG. 3 whereby to the plate-shaped part 3 a centrally arranged second cord 1' is connected which at its free end is also provided with a threading body 6' in the form of a wooden ball, whereby the threading body 6 at the other cord 1 is a lead ball. This variant of the cleaning device is especially suitable for cleaning soprano saxophones.

Figure 5:
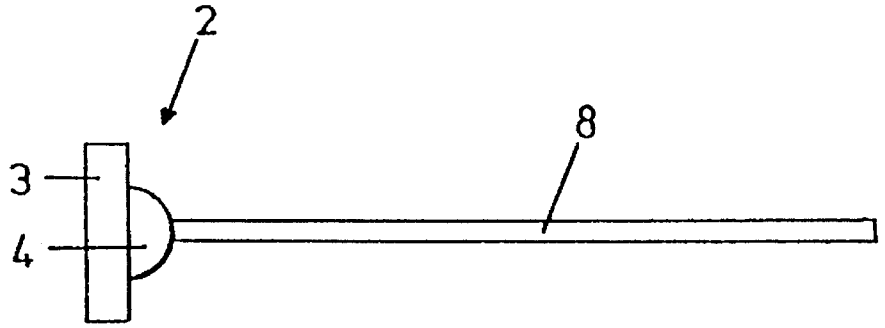
FIG. 5 shows a fifth embodiment in which the cleaning body is connected to a flexible rod.

The embodiment in FIG. 5 differs from the aforementioned embodiments, and especially from the most closely related embodiment as shown in FIG. 1, by having instead of the flexible cord 1 a more or less flexible rod 8 to which the cleaning body 2 is connected in the aforementioned manner.

Figure 6:
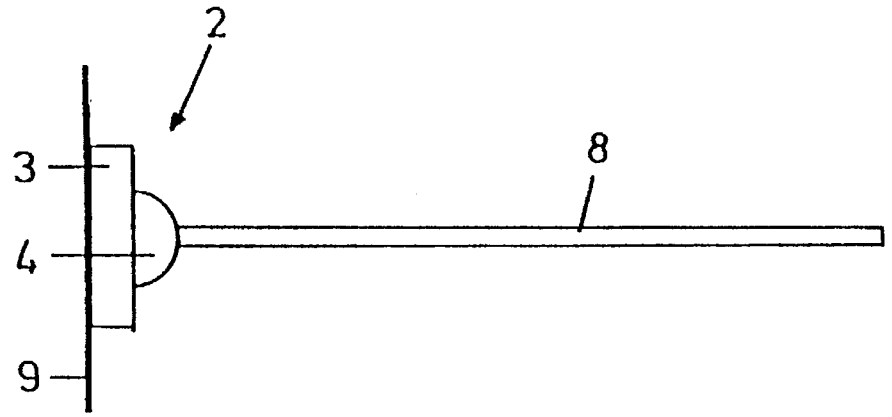
FIG. 6 shows a sixth embodiment similar to the embodiment of FIG. 5, but having an additional leather rag connected to the cleaning body.

A further embodiment is represented in FIG. 6 whereby the plate-shaped part 3 is additionally provided with a rag 9 made of leather. This cleaning device is especially suitable for cleaning flutes.

The present invention is, of course, in no way restricted to the specific disclosure of the specification and drawings, but also encompasses any modifications within the scope of the appended claims

What I claim is:

1. A device for cleaning an interior of a wind instrument, said device comprising:

a cleaning body said cleaning body comprising a convexly curved part and a circular disk with a top side said curved part and said disk each made of at least one of the materials selected from the group consisting of foamed rubber, foamed plastic, and foamed latex, and a bottom side, wherein said convexly curved part is selected from the group consisting of a segment of a sphere and a segment of ellipsoid;

wherein said segment has a front convexly curved surface and a planar rear surface and is connected with said planar rear surface to said top side of said circular disk;

said planar surface having a diameter that is smaller than a diameter of said circular disk;

an elongate pulling part having a first end connected to said front convexly curved surface remote from said circular disk for pulling said device through the wind instrument; and wherein said front convexly curved surface is a cleaning surface adapted to engage and clean the interior of the wind instrument when dulled therethrough.

2. A device according to claim 1 wherein said segment of a sphere is a semi-sphere.

3. A device according to claim 1, wherein said elongate pulling part is a flexible cord.

4. A device according to claim 3, wherein said cord is made of plastic.

5. A device according to claim 3 wherein said cord has a body connected to a free end thereof for threading said cord through the wind instrument.

6. A device according to claim 1, wherein said elongate pulling part is a cord having a pointed end for threading said cord through the wind instrument.

7. A device according to claim 1, further comprising a pulling cord connected to said bottom side of said circular disk.

8. A device according to claim 1, wherein said elongate pulling part is a flexible rod.

9. A device according to claim 1, further comprising a rag connected to said bottom side of said circular disk.

10. A device according to claim 9, wherein said rag is made of a material selected from the group consisting of leather and cloth.

* * * * *